United States Patent [19]

Mayer et al.

[11] 4,368,094

[45] Jan. 11, 1983

[54] PRODUCTION OF CORRUGATED CARDBOARD

[76] Inventors: Johann Mayer, Am Bergl 7, 8475 Saltendorf; Johann Maier, Döberlstrasse 16, 8480 Weiden; Hans Mosburger, Hüttenwerk 10, 8481 Weiherhammer; Michael Erl, Elchstrasse 18, 8481 Ullersricht, all of Fed. Rep. of Germany

[21] Appl. No.: 195,520

[22] Filed: Oct. 9, 1980

[30] Foreign Application Priority Data

Dec. 28, 1979 [DE] Fed. Rep. of Germany ..... 2952563

[51] Int. Cl.[3] ..... B31F 1/20; B31F 1/00

[52] U.S. Cl. ..... 156/462; 156/472; 156/473; 156/582; 425/369; 425/388

[58] Field of Search ..... 156/462, 472, 473, 582; 425/369, 388

[56] References Cited

U.S. PATENT DOCUMENTS 2,068,155 1/1937 Swift, Jr. ..... 156/473

4,251,313 2/1981 Abe ..... 156/472

*Primary Examiner*—Paul J. Thibodeau

*Attorney, Agent, or Firm*—Silverman, Cass & Singer, Ltd.

[57] ABSTRACT

Apparatus for the production of a corrugated cardboard having a cover-lining on at least one side, with an upper grooved roll and a lower grooved roll which have outwardly open annular grooves in distribution over their length, to which a suction source is connected through nozzles held by carriers, of which nozzles two in each case are arranged opposite to one another in the region of the paper web entry and exit of the lower grooved roll, fitting into an annular groove, characterized in that each annular groove (12) has a width substantially less than its depth, in that each nozzle (13, 13') which fittingly fills the annular groove possesses a pressed-flat pipe end (14, 14') and in that at least the outer nozzles of the nozzles arranged in a row are connectable additionally to an air blast source (32).

15 Claims, 5 Drawing Figures

PRODUCTION OF CORRUGATED CARDBOARD

BACKGROUND TO THE INVENTION

1. Field of the Invention

This invention relates to an apparatus for the production of corrugated cardboard having a cover-lining on at least one side.

2. Description of the Prior Art

Apparatus for the production of a corrugated cardboard having a cover lining on at least one side, with an upper grooved roll, a lower grooved roll which has outwardly open annular grooves in distribution over its length to which a suction source is connected by means of nozzles held by carriers, of which nozzles two in each case, lying opposite to one another, are arranged fitting into an annular groove in the region of the paper web entry and exit on the lower grooved roll.

Such an apparatus for the production of a corrugated cardboard having a cover-lining on at least one side is known from U.S. Pat. No. 2,068,155. In this case the lower grooved roll is provided with outwardly open annular grooves arranged side-by-side. Into each annular groove there extend two mutually opposite straight nozzles which possess a rectangular cross-section. These straight nozzles are connected by way of shut-off cocks to the pipes carrying the nozzles in rows, which in turn are connected to an air suction source. It is here disadvantageous that the width of the annular grooves is large in comparison with the annular groove depth, so that the shaping of the corrugated web is impaired. Moreover these nozzle rows are not also used to promote the approach of the web to be corrugated to the lower grooved roll and its departure therefrom.

The invention is based upon the problem of improving this known apparatus in that the shaping of the web to be corrugated is improved, the adaptation of the apparatus to different web widths is simplified, stoppages of the nozzles and of the annular grooves are avoided and the suction effect is made adaptable to the working speed of the apparatus.

SUMMARY OF THE INVENTION

Due to the especially narrow formation of the annular grooves and of the nozzle ends fitting into them, the pressing and thus shaping by the collaborating grooved rolls of the web to be corrugated is less impaired. Moreover due to the reduction of the intervals of the annular grooves and of the nozzles towards the ends of the lower grooved roll an adaptation of the suction effect to different web widths is achieved, and especially the marginal zones of the webs of different widths to be worked are subjected to the increased suction action, whereby the marginal regions of these webs are held securely without fluttering on the lower grooved roll. Since only the outer nozzle zones need to be capable of being shut off, furthermore a simplified formation of the nozzle connections is achieved. Finally a rapid and nevertheless limitedly movable securing of the nozzles is possible by the use of quick-action couplings. Furthermore the individual nozzles can be adjusted optimally to the position of the annular grooves in each case as a result of the use of limitedly displaceable annular sleeves. Finally the invention in the case of tearing of one or both fed webs permits the switching over of the nozzles from suction action to blowing action, so that the nozzle ends and annular grooves are kept free although the apparatus continues running. To avoid the danger that glue from the glue applicator may arrive on the lower grooved roll when the nozzles are switched over from suction to blowing it is also possible to move the glue applicator away from said grooved roll.

Finally due to the use of displaceable pistons, in the connection and carrier pipe for the nozzles, air suction can be applied to the one set of nozzles lying in the region of the paper web and air blowing can be applied to the other nozzles lying outside this web width, at the same time, while shut-off cocks for the individual nozzles are eliminated. The invention further provides controlling of the suction effect in dependence upon the working speed and thus achieving a better adaptation to maximum or reduced working speeds.

DESCRIPTION OF THE PREFERRED EMBODIMENTS

Figure 1:
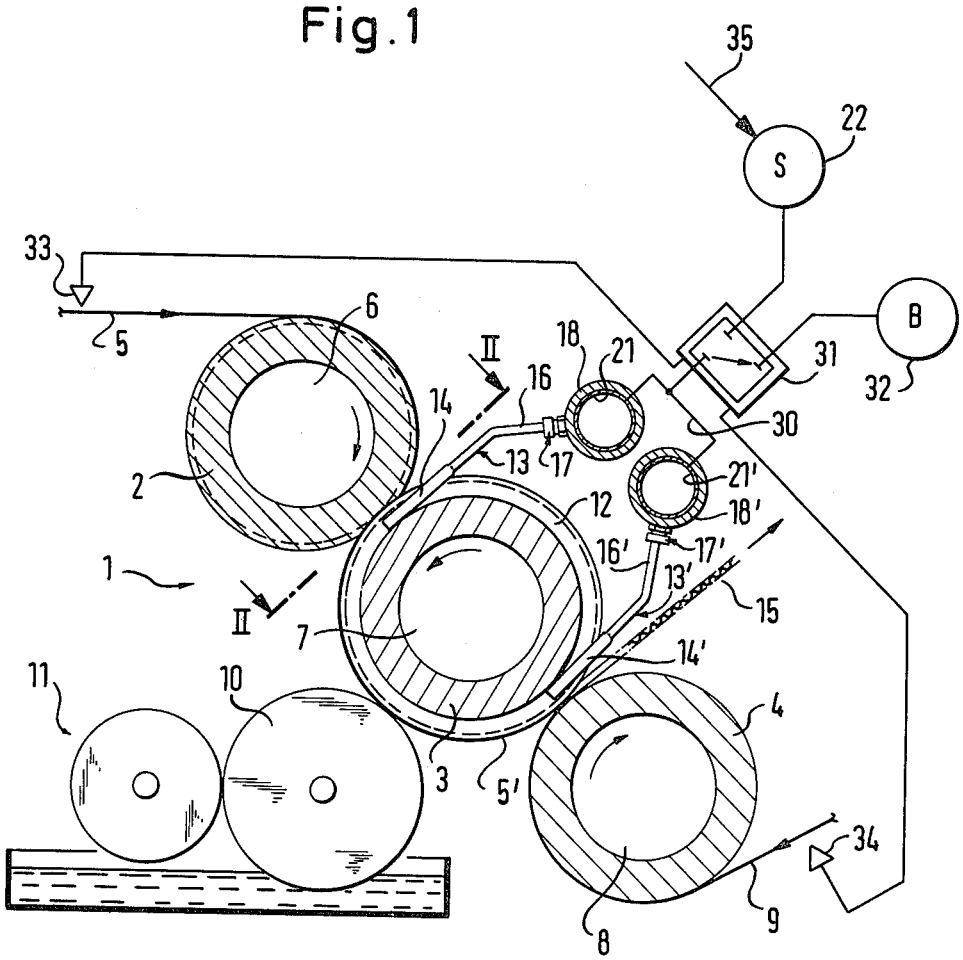
FIG. 1 shows a diagrammatic lateral elevation of the apparatus for the production of a corrugated cardboard having a cover-lining on at least one side.

The apparatus 1 for the production of a corrugated cardboard having a cover-lining on at least one side consists as usual, of an upper grooved roll 2, a lower grooved roll 3 and a presser roll 4.

A paper web 5 coming from a feed roll stand (not shown) is fed in the direction of the indicated arrow to the upper grooved roll 2 which is serrated with appropriate profile.

In the region of engagement of the lower grooved roll 3, serrated likewise with corresponding matching profile, the paper web 5 is durably corrugated by pressing.

For better fixing of the corrugation the lower grooved roll 3, as also the upper grooved roll 2 and the presser roll 4, can be heated for example with steam by way of their cavities 6, 7, 8.

A cover web 9 coming likewise from a feed roll stand (not shown) is fed in the indicated arrow direction to the presser roll 4.

The rolls 2, 3 and 4 rotate in the directions of the arrows indicated. The lower grooved roll 3 and the presser roll 4 can be driven.

In the region where the presser roll 4, provided with a smooth surface, co-operates with the lower grooved roll 3 the cover-lining web 9 is pressed against the corrugation crests of the corrugated web 5' arriving by way of the lower grooved roll 3. Since the outer surfaces of the corrugation crests are provided with glue by the glue applicator roll 10 of the glue applicator 11, the cover lining web 9 supplied by way of the presser roll 4 is glued to the corrugated web 5'.

For the secure retention of the corrugated web 5' on the circumferential region of the lower fluted roll 3 the latter is provided with outwardly open annular grooves 12 arranged at intervals in the longitudinal direction. The width of the annular grooves 12 is as small as possible, preferably less than 3 mm., in order not to impair the shaping effect of the grooved rolls 2, 3. The depth of the annular grooves 12 of the grooved roll 3 amounts to several times the annular groove width, preferably 13 mm.

Nozzles 13, 13' extend with their ends 14, 14' into each annular groove 12, fitting with slight clearance. The nozzle ends 14, 14' are arranged opposite to one another in the regions of action of the upper and lower grooved rolls 2, 3 and of the lower grooved roll 3 and presser roll 4. The straight ends 14, 14' of the nozzles 13, 13' lie approximately tangential to the bottoms of the annular grooves 12. Thus they co-operate in transferring the web 5, coming from the upper grooved roll 2, to the lower grooved roll 3, in lifting away the corrugated web 5' guided over the lower grooved roll 3, after the pressing on and gluing of the cover-lining web 9, and in conducting the corrugated cardboard web 15, having a cover-lining on one side, in a straight path in the direction of the indicated arrow.

The nozzles 13, 13' are arranged in an upper row and in a coinciding lower row. They are angled off towards their ends 16 in order to offer more free space for the departing corrugated cardboard web 15.

The nozzles 13, 13' are produced from a tube which is pressed flat and surface-hardened at the end 14, 14'.

Figure 3:
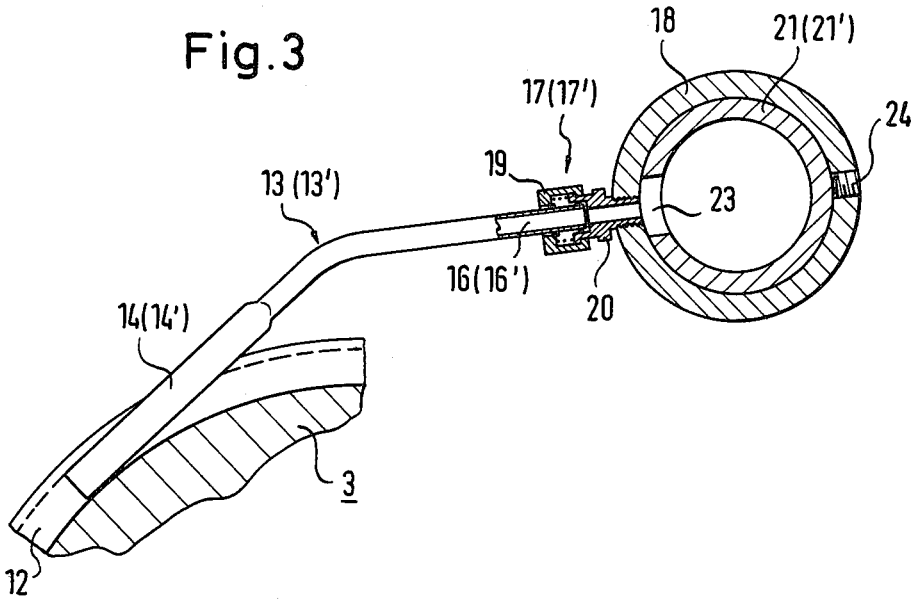
FIG. 3 shows a sectional view of a nozzle with securing.

As may be seen from FIG. 3, the other end 16, 16' is detachably connected with a ring 18, 18' through a quick-action coupling 17, 17' of a construction type known per se. The nozzle end 16, 16' is in this case secured in sealed manner in the quick-action coupling 17, 17' for limited rotation about its longitudinal axis and limited pivoting to and fro. Thus it becomes possible to adapt the nozzle ends 14, 14' to the positions of the annular grooves 12. The quick-action coupling 17, 17' consists of an outer ring 19 which is displaceable against spring action on an inner coupling piece 20 and in the rest position, when the nozzle end 16, 16' is inserted, clamps the latter fast in sealed manner. The inner coupling piece 20 is firmly connected with the ring 18, 18'.

The ring 18, 18' is pushed on to a pipe 21, 21' which serves as carrier pipe for the entire row of nozzles in each case. At the same time an air suction source 22 is connectable to the pipe 21, 21'. The pipe 21, 21' has appropriately for each nozzle 13, 13' a hole 23 the diameter of which is larger than the bore of the quick-action coupling 17, 17'. Thus it is possible to displace the ring 18, 18' with nozzle 13, 13' limitedly in the longitudinal direction of the pipe in order to align the respective nozzle 13, 13' with the associated annular groove 12. The ring 18, 18' can be made fast on the pipe 21, 21' by a screw 24.

FIG. 1 shows that for reasons of greater free space especially for the departing corrugated cardboard 15, the pipes 21, 21' are set back in relation to planes which extend tangentially of the points of contact of the nozzles 13, 13' with the lower grooved roll 3.

Figure 4:
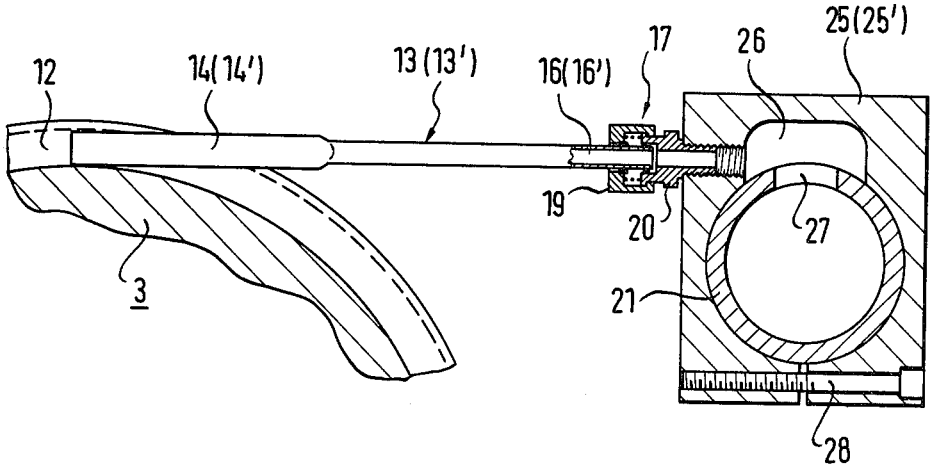
FIG. 4 shows a modified form of embodiment of a nozzle with securing according to FIG. 3.

According to FIG. 4, instead of being cranked the nozzles 13, 13' can also be made straight. It is again connected with the pipe 21, 21' through a quick-action coupling 17, 17' by way of a sleeve piece 25, 25'. The sleeve piece 25, 25' possesses in the longitudinal direction of the pipe an elongated depression 26 which is seated over a bore 27 on the upper side of the pipe 21. The sleeve piece 25, 25' is slotted on the under side and can be clamped fast on the pipe 21, 21' by a clamping screw 28. Due to the special formation of the sleeve piece 25, 25' and association with the nozzle 13, 13' a correspondingly large free space is achieved as in the case of the angled nozzle 13, 13'. The pipes 21, 21' again lie staggered in the direction towards one another in relation to the tangential planes of the points of nozzle contact.

As may be seen from FIG. 1, the two parallel pipes 21, 21' lying one below the other are connected with one another through conduits 30 and are connectable alternately by a control valve 31 to a suction source 22 or an air blast source blower 32. A feeler 33 for the arriving web 5 and a feeler 34 for the arriving web 9 are connected to the control valve 31. If the web 5 and/or 9 should tear away the respective feeler 33, 34 automatically controls the control valve 31 from the connection position for the suction source 22 to the connection position for the air blast source 32. Thus the object is achieved that if a web 5 is torn and no longer fed to the grooved rolls 2, 3, the annular grooves 12 and also the ends 14 of the nozzles 13 are blown clear.

Figure 2:
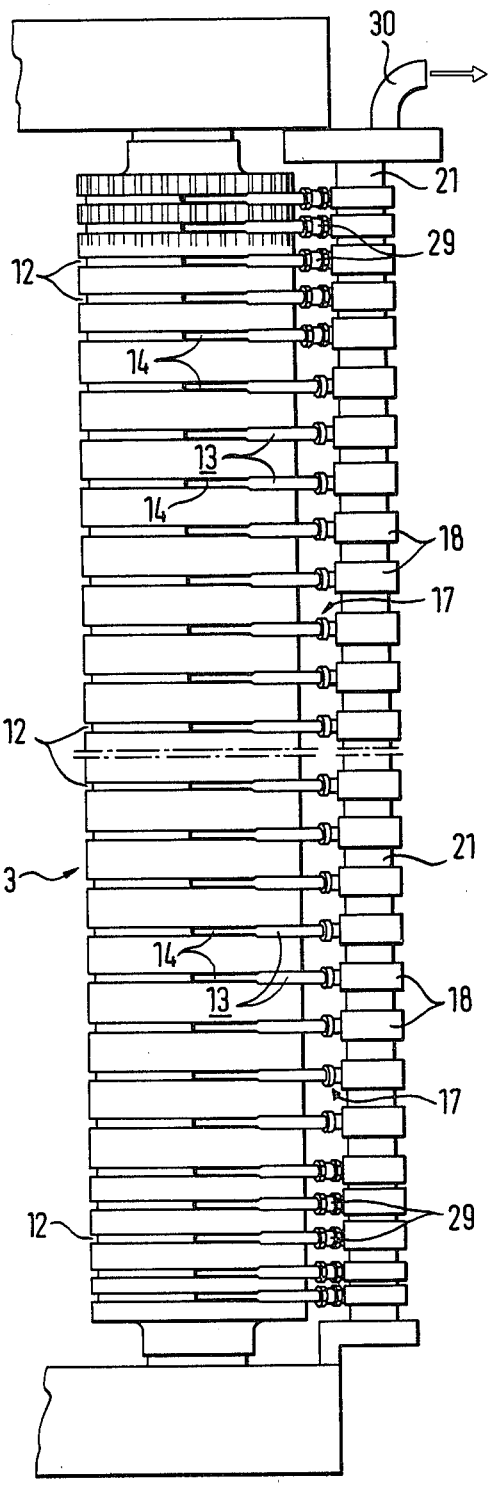
FIG. 2 shows a section along the line II—II in FIG. 1.

According to FIG. 2 the intervals of the annular grooves 12 can reduce towards the ends of the grooved roll 3. The intervals can be equal over the middle region of the roll, namely over a region which is smaller than the minimum paper width ordinarily to be utilised. Over the adjoining marginal zones the interval of the annular grooves is reduced. Thus the object is achieved that despite changing paper web width, the suction effect is increased in the marginal zones of the paper web due to the correspondingly closer placing of the nozzles 13.

As can also be seen, a shut-off valve 29 can be allocated to each nozzle fastening in the outer web region so that the outer nozzles 13' which are not required can be shut off individually.

In order that the suction effect of the nozzles 13, 13' can be adapted to the working speed of the apparatus 1 in each case, it is variable in dependence upon the working speed in each case. The variation can here take place by steps or continuously. For this purpose a feeler 35 is provided which ascertains the speed of rotation for example of the roll 3 and influences the suction effect of the nozzles 13, 13'. For this purpose the speed of rotation of a fan constituting the suction source 22 can be controlled by the feeler 35. It is also possible for the passage cross-section of a by-pass for external air or a constriction in the suction conduit of the suction source to be controlled.

Figure 5:
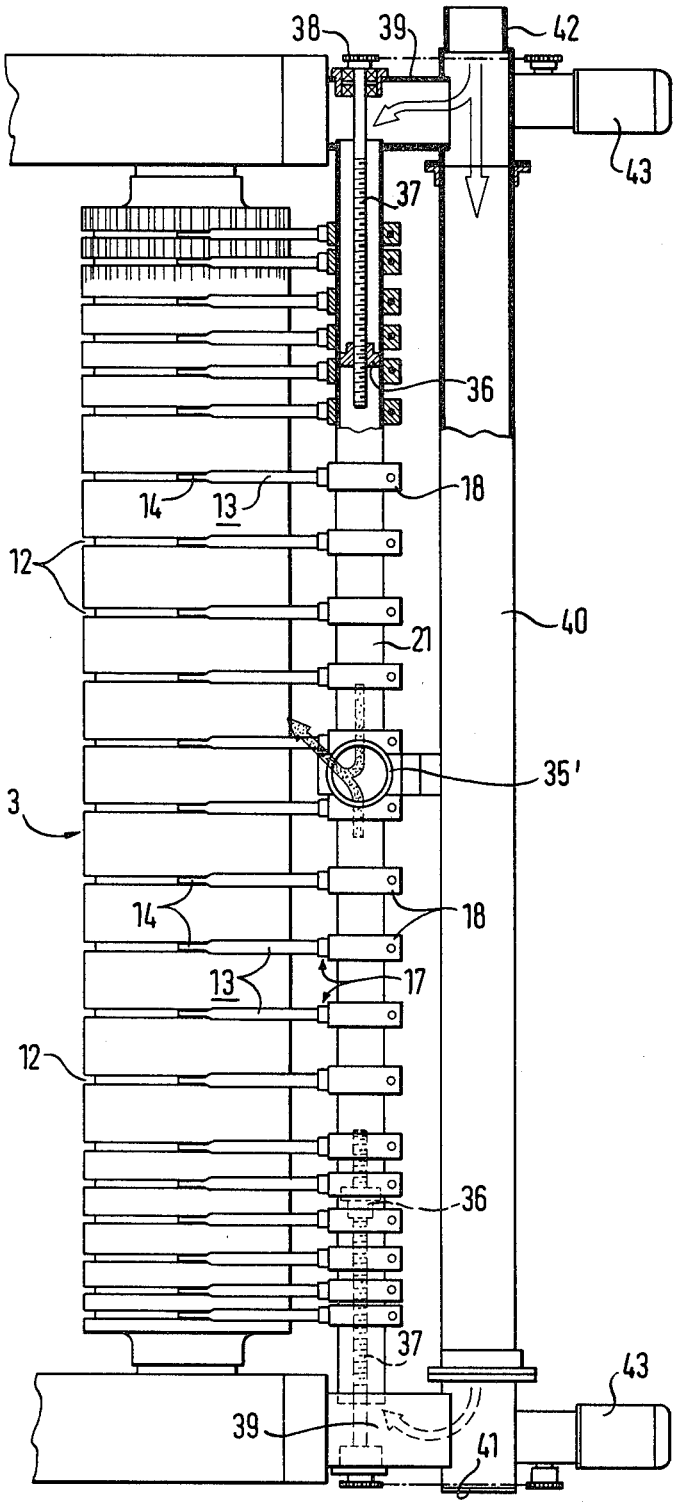
FIG. 5 shows a view corresponding to FIG. 2 of a modified form of embodiment.

FIG. 5 shows a modified embodiment where the pipe 21 is connected in the middle by means of a connection piece 35' to the suction source 22, so that air is sucked away in the indicated arrow direction. In each of the ends of the pipe 21 there is a piston 36 which is displaceable by means of a threaded spindle 37. The drive of the threaded spindle 37 can be effected by hand or by sevomotors through a chain drive system 38. If motor setting of the pistons takes place this can be effected automatically according to the web width by web edge feelers, by a programme control system or the like.

The ends of the pipe 21 are connected by connection pieces to a connecting conduit 40. The connecting conduit 40 is closed at the one end 41 and connected at the other end through a conduit 42 to the air blast source 32. In this way it becomes possible to utilise a constantly connected air blast source 32. The nozzles situated outside the paper web are supplied with air blast when the pistons 36 are in the appropriate position. The nozzles 13, 13' which are closed off from the air blast source by the pistons and lie within the paper web width are connected to the suction source 22 by way of the connection piece 35'. Thus in operation the nozzles situated within the paper web width will suck while those situated outside will blow. The connection piece 35' can be connected, as shown in FIG. 1, by way of the control valve 31 to the two sources 22 and 32, so that accordingly the nozzles which suck during operation are switched over automatically to air blast if a web should tear away.

In place of the shut-off cocks 29 allocated to the nozzles 13, 13' it is also possible to use three-way valves which render it possible to connect the air suction source or the air blast source by hand or automatically.

In the form of embodiment according to FIG. 5 shut-off cocks for the individual nozzles are eliminated. The suction source 22 and the blowing source 32 can also be formed by one single appliance, for example a fan. The suction side and the delivery side thereof are then connected for example to the control valve 31.

We claim:

1. Apparatus for the production of corrugated cardboard typically having a coverlining on at least one side, comprising an upper, longitudinally grooved roll; a lower, longitudinally grooved roll additionally having a plurality of outwardly open annular grooves distributed along its length, said annular grooves being connected to a suction source through respective nozzles held by carriers; said nozzles being arranged in pairs with the nozzles in each pair generally opposing one another in respective regions of web entry upon and exit from said lower grooved roll, said nozzles in each pair positioned in conforming fit into the same annular groove, wherein said annulr grooves have a width of about 3 mm or less, and further comprising a blower interruptedly connected by control means to at least the outermost of said nozzles fitted into those of said annular grooves which are located most adjacently to respective ends of said lower grooved roll.

2. Apparatus according to claim 1, wherein each said pair of nozzles are connected to said blower.

3. Apparatus according to claims 1 or 2, wherein said nozzles are connected through respective valve means to one of said suction source and said blower.

4. Apparatus according to claims 1 or 2, further comprising feelers for sensing arriving webs, said feelers actuating valve means connecting at least one of said nozzles to one of said suction source and said blower upon respective sensing of untorn webs or torn webs.

5. Apparatus according to claim 1, wherein the level of suction through the nozzles is variable in dependence upon the working speed of the grooved rolls.

6. Apparatus according to claim 5, wherein the level of suction through said nozzles is variable by stages.

7. Apparatus according to claims 1, wherein the longitudinal spacing of said annular grooves and said nozzles reduces towards the ends of the lower grooved roll.

8. Apparatus according to claim 7, wherein the longitudinal spacing of the nozzles in a middle region of the lower grooved roll is uniform.

9. Apparatus according to claim 1, further comprising a pipe extending generally parallel to and coextensive with the ends of said lower grooved roll, said pipe forming a main conduit to which each of said nozzles is connected, and wherein said suction source is connected to said pipe at approximately the middle of the length of said pipe and said blower is connected to both of the ends of said pipe, and further comprising a piston adjustably projecting longitudinally into each of the respective ends of said pipe to form an adjustable valve between suction and blowing within said pipe, thereby to provide at least some of said nozzles with alternative connection to said suction source or said blower.

10. Apparatus according to claim 1, wherein said nozzles are of curved formation in the longitudinal direction thereof.

11. Apparatus according to claim 1, wherein at least one said nozzles is securable on a pipe forming a main conduit on which said carriers are mounted and to which said nozzles is connected through a respective annular sleeve fitting into a respective opening in said pipe, said opening in said pipe being larger than the opening through said sleeve.

12. Apparatus according to claim 11, wherein a quick-action coupling is provided on the annular sleeve for detachable securing of the nozzle.

13. Apparatus according to claim 12, wherein said quick-action coupling includes a shut-off valve for the nozzle.

14. Apparatus according to claim 1, wherein at least one of said nozzles includes a pressed-flat and surface-hardened end engaging in said respective annular groove.

15. Apparatus for the production of corrugated cardboard typically having a cover-lining on at least one side, comprising an upper, longitudinally grooved roll; a lower, longitudinally grooved roll additionally having a plurality of outwardly open annular grooves distributed along its length, said annular grooves being connected to a suction source through respective nozzles held by carriers; said nozzles being arranged in pairs with the nozzles in each pair generally opposing one another in respective reqions of web entry upon and exit from said lower grooved roll, said nozzles in each pair positioned in conforming fit into the same annular groove, further comprising a pipe extending generally parallel to and coextensive with the ends of said lower grooved roll, said pipe forming a main conduit to which each of said nozzles is connected, and wherein said suction source is connected to said pipe at approximately the middle of the length of said pipe, and wherein both of the ends of said pipe are interruptedly connected to a blower by control means, and further comprising a piston adjustably projecting longitudinally into each of said respective ends of said pipe to form an adjustable valve for separation between suction and blowing within said pipe, thereby for providing at least some of said nozzles with alternative connection to said suction source or said blower.

* * * * *